US011148847B2

(12) United States Patent
Bueti et al.

(10) Patent No.: US 11,148,847 B2
(45) Date of Patent: Oct. 19, 2021

(54) PLASTIC NECK OUTSERT FOR METAL BEVERAGE CONTAINER

(71) Applicant: PepsiCo, Inc., Purchase, NY (US)

(72) Inventors: Girolama Bueti, Yorktown Heights, NY (US); Gary Joseph Albaum, Pleasantville, NY (US); Bruno Telesca, Sandy Hook, CT (US); Hassan Mourad, Canton, MI (US); Harold James Marshall, Forest, VA (US)

(73) Assignee: PepsiCo, Inc., Purchase, NY (US)

( * ) Notice: Subject to any disclaimer, the term of this patent is extended or adjusted under 35 U.S.C. 154(b) by 181 days.

(21) Appl. No.: 16/400,805

(22) Filed: May 1, 2019

(65) Prior Publication Data

US 2020/0346812 A1 Nov. 5, 2020

(51) Int. Cl.
*B65D 1/02* (2006.01)
*B65D 41/08* (2006.01)
(Continued)

(52) U.S. Cl.
CPC ..... *B65D 1/0246* (2013.01); *B21D 51/26* (2013.01); *B65B 7/2835* (2013.01);
(Continued)

(58) Field of Classification Search
CPC ..... B65D 1/0246; B65D 1/0207; B65D 1/02; B65D 1/023; B65D 51/145; B65D 51/18;
(Continued)

(56) References Cited

U.S. PATENT DOCUMENTS 3,124,273 A 3/1964 Remington et al.
3,517,847 A * 6/1970 Guala ..... B65D 51/18 215/256
(Continued)

FOREIGN PATENT DOCUMENTS

CA 2 595 963 A1 8/2006
CN 101348182 A 1/2009
(Continued)

OTHER PUBLICATIONS

International Search Report in PCT/US2020/30753, dated Aug. 4, 2020, 9 pages.

*Primary Examiner* — Robert J Hicks
(74) *Attorney, Agent, or Firm* — Sterne, Kessler, Goldstein & Fox P.L.L.C.

(57) ABSTRACT

A metal bottle assembly adapted for use on a plastic bottling includes a metal bottle with an outsert assembled on the neck portion of the bottle. The outsert may be constructed from plastic material and may be fixed to the bottle using an interference fit. The outsert enables the bottle to be placed on a plastic bottling line with minimal or no modifications to the bottling line. The outsert also ensures that the metal bottle is not damaged by handling on the plastic bottling line. In some embodiments, the outsert is designed to elastically deform as it is pressed on the neck of a pre-formed metal bottle and therefore create the interference fit between the outsert and the bottle. In some embodiments the outsert is retained on the neck of the bottle through the interference fit alone.

26 Claims, 9 Drawing Sheets

(51) Int. Cl.
*B67B 3/20* (2006.01)
*B21D 51/26* (2006.01)
*B65B 7/28* (2006.01)

(52) U.S. Cl.
CPC ..... *B65D 1/0207* (2013.01); *B65D 41/08* (2013.01); *B67B 3/20* (2013.01); *B65D 2401/50* (2020.05)

(58) Field of Classification Search
CPC ..... B65D 41/08; B65D 41/22; B65D 41/086; B65D 41/62; B65D 41/04; B65D 41/06; B67B 3/20; B67B 3/206; B65B 7/2835; B65B 7/28
USPC ..... 215/44, 43, 42, 276, 274, 273, 277, 329, 215/316, 387, 386, DIG. 4; 220/296, 220/293, 288, 319; 222/567, 566; 53/471, 467, 485, 484
See application file for complete search history.

(56) References Cited

U.S. PATENT DOCUMENTS 5,662,233 A * 9/1997 Reid ..... B65D 41/58 215/273
6,010,026 A 1/2000 Diekhoff et al.
6,588,614 B2 7/2003 Neuner
6,695,160 B1 2/2004 Culley et al.
6,779,677 B2 8/2004 Chupak
6,802,196 B2 10/2004 Gong et al.
6,907,653 B2 6/2005 Chupak
6,929,137 B1 8/2005 Granger et al.
6,948,630 B2 9/2005 Julian et al.
7,182,213 B2 2/2007 King
7,690,521 B1 4/2010 Herrera
7,694,835 B1 4/2010 Montgomery
7,798,357 B2 9/2010 Hanafusa et al.
7,832,589 B2 11/2010 Dunwoody et al.
7,874,420 B2 1/2011 Coon
7,922,018 B2 4/2011 Granger et al.
7,946,436 B2 5/2011 Laveault et al.
8,011,535 B2 9/2011 Taubner et al.
8,087,523 B2 1/2012 Kiehne
8,091,724 B2 1/2012 King
8,360,266 B2 1/2013 Adams et al.
8,381,561 B2 2/2013 Santamaria et al.
8,434,652 B2 5/2013 Rushe et al.
8,511,639 B2 8/2013 Johnson
8,523,024 B2 9/2013 Piscopo et al.
8,672,156 B2 3/2014 Martinovic et al.
8,689,987 B2 4/2014 Lewis
8,763,829 B2 7/2014 Madaus
9,254,942 B2 2/2016 Elliot et al.
9,346,591 B2 5/2016 Martinengo
9,359,117 B2 6/2016 Russell et al.
9,669,971 B2 6/2017 Panec et al.
9,707,615 B2 7/2017 Dick et al.
9,821,926 B2 11/2017 Robinson et al.
9,844,805 B2 12/2017 Siles et al.
9,957,076 B2 5/2018 Tung et al.
10,040,593 B2 8/2018 Ross et al.
10,106,298 B2 10/2018 Watkins et al.
10,131,473 B2 11/2018 Sterling et al.
2001/0040167 A1* 11/2001 Flecheux ..... B65D 41/08 220/634
2004/0129729 A1* 7/2004 Thomson ..... B65D 49/04 222/153.06
2007/0051687 A1* 3/2007 Olson ..... B21D 51/38 215/44
2008/0038500 A1 2/2008 Page et al.
2008/0302755 A1* 12/2008 Ribi ..... B65D 51/20 215/316
2011/0113732 A1 5/2011 Adams et al.
2013/0220964 A1 8/2013 Adams et al.
2015/0027974 A1 1/2015 Niec
2015/0147430 A1 5/2015 Dzikowicz et al.
2015/0329232 A1 11/2015 Brozell et al.
2016/0167850 A1 6/2016 Mclaren et al.
2016/0256910 A1 9/2016 Niec et al.
2017/0297783 A1 10/2017 Defert
2017/0349341 A1 12/2017 Girardot et al.
2018/0127170 A1 5/2018 Kasper et al.
2018/0170625 A1 6/2018 Sung
2018/0345538 A1 12/2018 Smith et al.
2018/0360245 A1 12/2018 Belmar et al.
2018/0362222 A1 12/2018 Allen

FOREIGN PATENT DOCUMENTS

CN 205470513 U 8/2016
GB 2457812 A * 9/2009 ..... B65D 1/023
WO WO 2012/134413 A1 10/2012
WO WO 2016/150734 A1 9/2016

* cited by examiner

PLASTIC NECK OUTSERT FOR METAL BEVERAGE CONTAINER

FIELD

This disclosure generally relates to beverage bottles. More specifically, some embodiments relate to metal beverage bottles with plastic outserts at their necks.

BACKGROUND

Metal beverage bottles may include relatively smooth necks. They may generally not accept plastic closures, and may generally not have a neck structure that allows them to be filled and processed on a plastic bottling line.

SUMMARY

In embodiments, an outsert for a bottle includes an upper portion, wherein the upper portion has a smooth, continuous interior surface and threads disposed on an exterior surface of the upper portion. A lower portion is disposed below the upper portion, wherein the lower portion has a smooth, continuous interior surface. A support flange is disposed on an exterior surface of the lower portion. The transition between the upper portion and the lower portion tapers inward toward the upper portion. An inner diameter of the upper portion is less than an inner diameter of the lower portion.

In embodiments a bottle includes a metal body, the metal body including a neck portion, wherein the neck portion includes a rolled upper edge; an upper region disposed below the rolled upper edge, the upper region having a first outer diameter; a lower region disposed below the upper region, the lower region having a second outer diameter, greater than the first outer diameter; and a tapered transition region disposed between the upper region and the lower region. The bottle also includes an outsert disposed on the neck portion. The outsert includes an upper portion disposed around the upper region of the body and with exterior threads, the upper portion of the outsert does not contact at least a portion of the upper region of the body. The outsert also includes a lower portion disposed around the lower region of the body, wherein the lower portion of the outsert contacts at least a portion of the lower region of the body.

BRIEF DESCRIPTION OF THE FIGURES

The accompanying drawings, which are incorporated herein and form part of the specification, illustrate embodiments of the present invention and, together with the description, further serve to explain the principles of the invention and to enable a person skilled in the relevant art(s) to make and use the invention.

DETAILED DESCRIPTION

Figure 1:
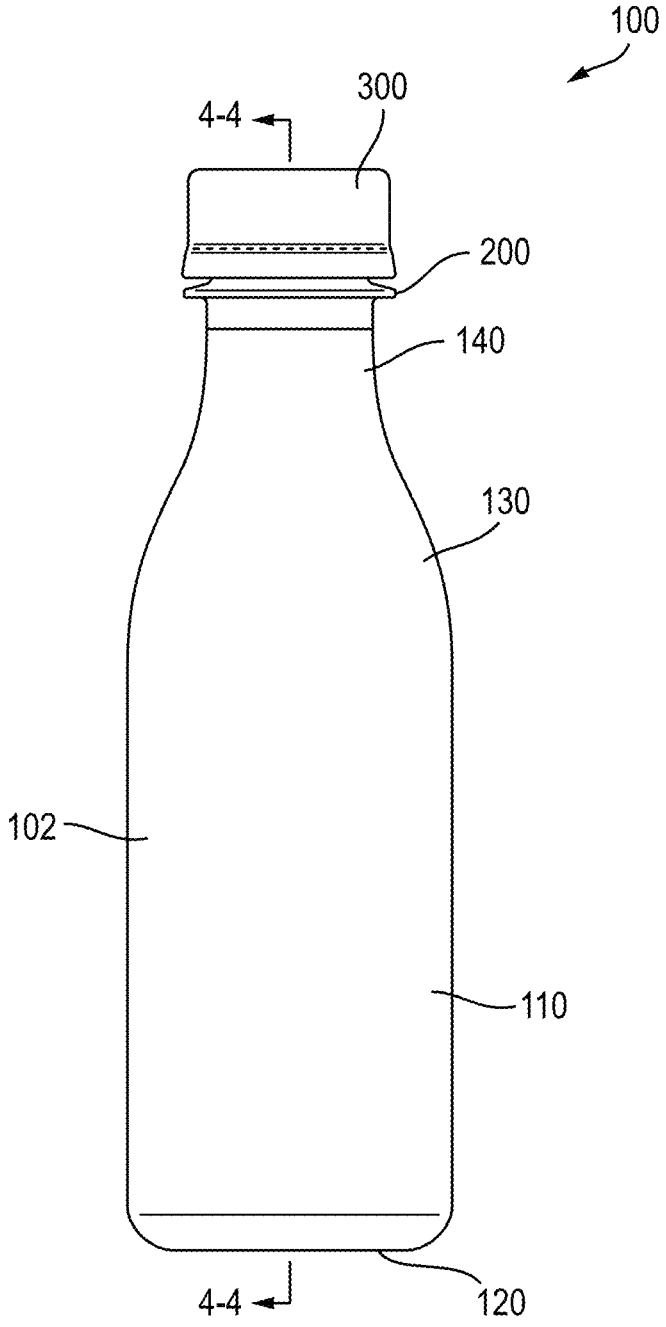
FIG. 1 is a front view of a beverage container.

The present invention(s) will now be described in detail with reference to embodiments thereof as illustrated in the accompanying drawings. References to "one embodiment," "an embodiment," "an exemplary embodiment," "some embodiments," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

Beverage containers may be made from a range of different materials. Because of their low cost and relatively high durability, plastic beverage containers are widely used throughout the beverage industry and are among the leading types of beverage containers in use. As a result, many beverage bottling lines are designed to fill plastic beverage containers. Many plastic bottling lines are designed to fill bottle-type beverage containers by gripping the bottle on the neck just below a support flange. This support flange is typically located immediately below the threads for the bottle cap on a plastic bottle. The popularity of plastic bottling lines makes it desirable to adapt beverage containers made from different materials for use on plastic bottling lines to reduce costs and simplify the beverage bottling process. For example, according to some embodiments described herein, adapting a beverage container, such as a metal beverage container, to function on a plastic bottling line involves providing a neck finish similar to that of the plastic beverage containers used on the line (e.g., ensuring that the gripping mechanism of the bottling line is able to properly engage the beverage container, as it would with a typical plastic container). Some embodiments provide a similar interfacing structure on the metal beverage container, including a support flange, to ensure that the gripping mechanism can properly grip the metal beverage container during bottling. However, forming a flange in a metal beverage container that is similar to those found on plastic bottles would be difficult and costly.

Accordingly, some embodiments described herein include a plastic outsert for a metal beverage container that is assembled onto the neck of the container. When assembled on the metal beverage container, or bottle, the outsert allows the metal beverage container to be used on a plastic bottle line. As discussed in further detail below, the design of the outsert includes an interface designed to engage with the plastic bottling line. This combination of outsert and beverage container allows a standard metal beverage container to be formed without any complex interface structures, but still enables the metal beverage container to be used on the plastic bottling line. Further, the outsert has an additional advantage of allowing the metal bottle to be capped with a plastic bottle cap, like those found on a plastic bottle. This further enhances the compatibility of the metal bottle with the plastic bottling line.

Further, the outsert is designed to allow it to be assembled onto a pre-formed metal bottle. For example, this enables the use of metal bottles formed by a sheet metal forming process, which does not readily allow for process interruption for a step such as applying an outsert. It also reduces costs by increasing supply line flexibility. Embodiments of the outsert discussed below may provide one or more of these benefits, as well as further benefits discussed below.

A metal beverage container, or bottle, 100 as shown in FIG. 1 includes a middle section 110, an outsert 200, and a cap 300. Bottle body 102 includes a bottom 120, a middle section 110 (e.g. a cylindrical middle section), a neck portion 140, and a tapered portion 130 connecting middle section 110 with the neck portion 140. As shown, for example, in FIG. 2, neck portion 140 has an opening 142 located at the end of neck portion 140 opposite from bottom 120.

Figure 4:
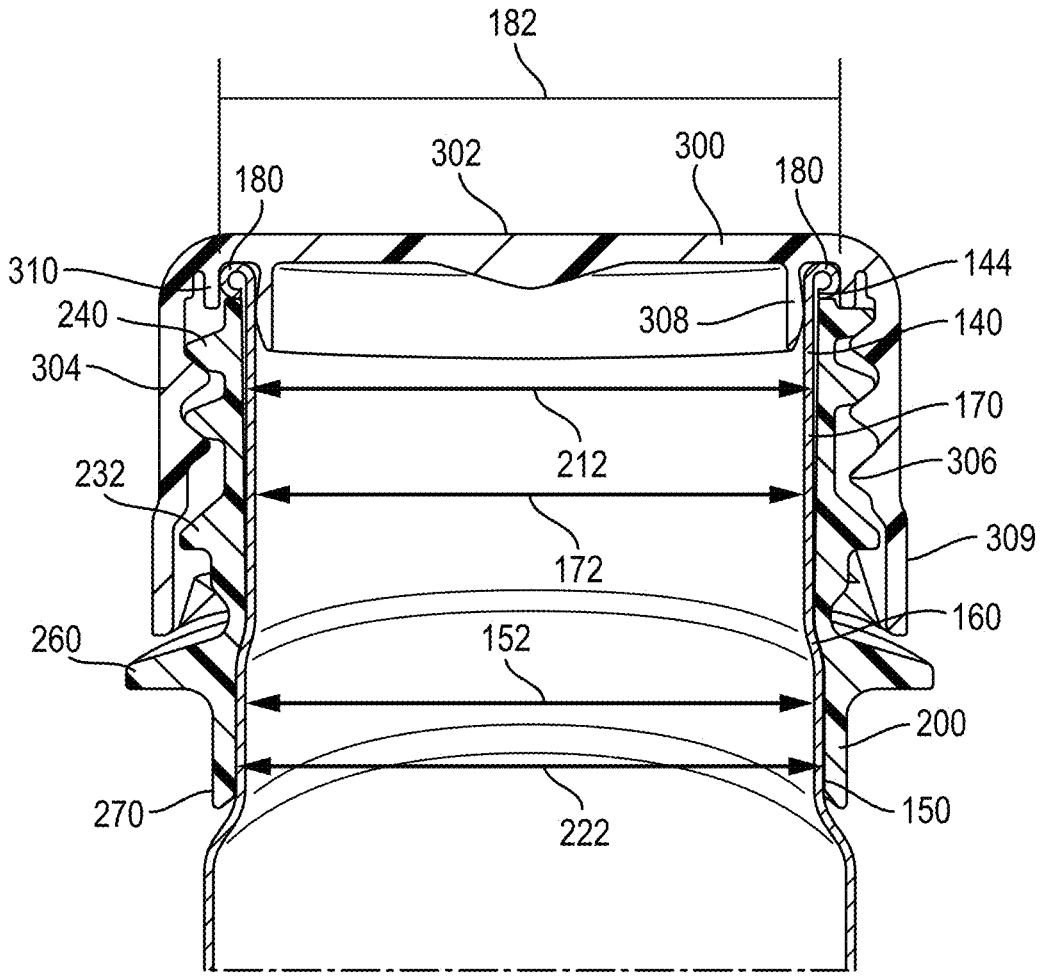
FIG. 4 is a cross-section view of the neck finish of the beverage container of FIG. 1.

FIG. 4 shows a cross-sectional view of an upper portion of bottle 100 taken along line 4-4 in FIG. 1. As shown in FIG. 4, for example, neck portion 140 may have a lower region 150 disposed below a transition region 160. Transition region 160 connects to an upper region 170 disposed above transition region 160. Lower region 150 and upper region 170 may have smooth cylindrical or frustoconical shapes, with straight walls when viewed in vertical cross-section (as in FIG. 4). In some embodiments, opening 142 is located at the distal end of upper region 170. Lower region 150 and upper region 170 may be cylindrical. Lower region 150 may have an external diameter 152 that is greater than an external diameter 172 of upper region 170. For example, a lower end of upper region 170 may have a smaller external diameter than an upper end of lower region 150 (e.g., external diameter 152 may be 24.5 mm and external diameter 172 may be 22.5 mm). Transition region 160 may connect between lower region 150 and upper region 170, and bridge such differences in diameter. In these embodiments, transition region 160 has a tapering (e.g., frustoconical) shape to smoothly transition from larger lower region 150 to smaller upper region 170 for easier assembly.

Figure 5:
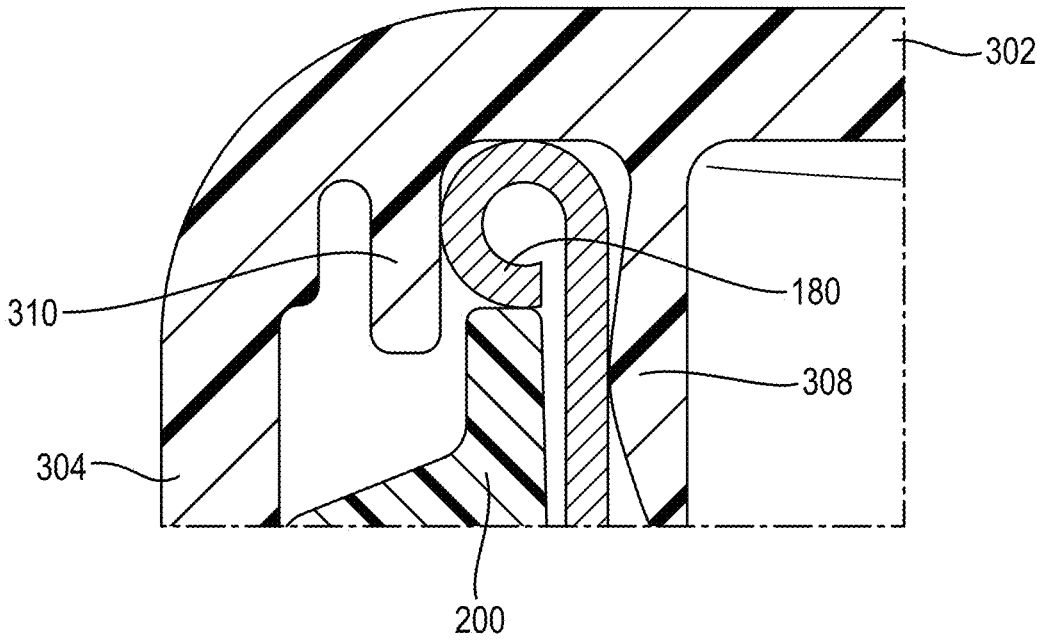
FIG. 5 is a detail view of a portion of FIG. 4.
Figure 6:
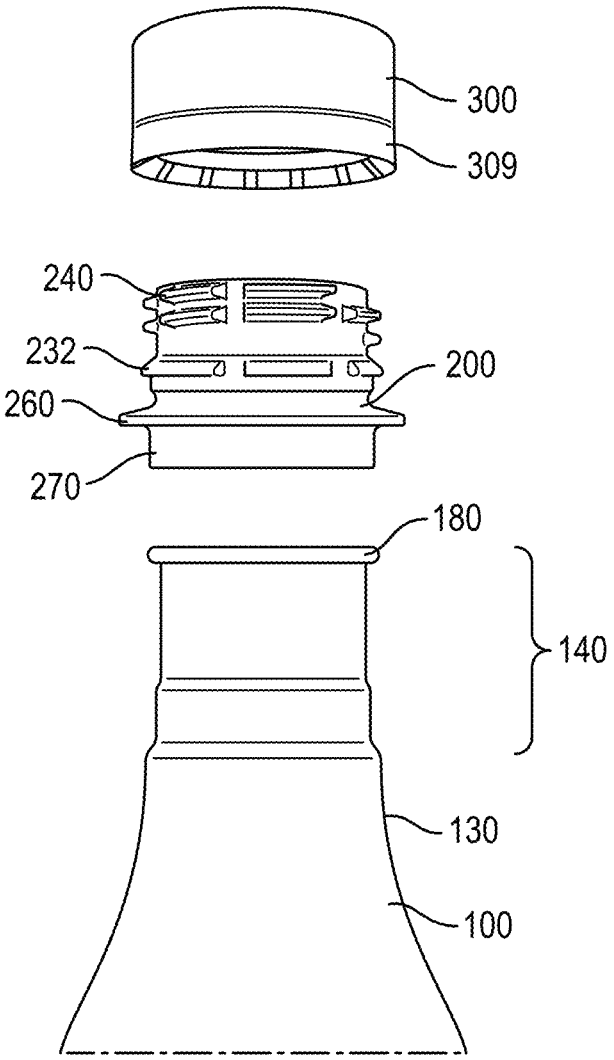
FIG. 6 is a pre-assembly view of the beverage container of FIG. 1.

In some embodiments, bottle 100 may include a rolled edge 180 disposed at an upper edge 144 of neck portion 140. As shown in FIGS. 4 and 5, rolled edge 180 may be formed by rolling upper edge 144 of neck portion 140 outward until upper edge 144 is proximate to or in contact with the exterior surface of neck portion 140. However, rolled edge may also be a separate ring of material that is added to neck portion 140, for example by using welding, adhesives, or other known techniques. In some embodiments, the dimensions of rolled edge 180 are configured to mimic the dimensions of an opening of a standard plastic bottle. This further enhances compatibility of bottle 100 with a plastic bottling line. Rolled edge 180 is also configured to present a finished, smooth surface at opening 142, which is desirable for an improved consumer experience when drinking a beverage from bottle 100. In some embodiments, rolled edge 180 may have a non-circular cross section, such as an oval or square cross section. For example, while in some embodiments rolled edge 180 may define a rounded upper surface and a rounded outer side surface, in some embodiments it may alternatively or additionally define a flat upper surface or a flat outer side surface.

In some embodiments, bottle 100 may be made from metal (e.g., aluminum or stainless steel). For example, bottle 100 may be formed through sheet forming, which is a process of bending, rolling, and/or drawing a precut sheet of metal into a desired shape. Rolled edge 180 may be formed during this process. As discussed above, bottle 100 may be fully-formed prior to assembly with the outsert. In some embodiments, the exterior surface of neck portion 140 may be smooth, which is to say it may be manufactured without any protrusions and may have a surface roughness similar to that of a metal part made using the same manufacturing process used to form bottle 100. In particular, the parts of neck portion 140 that the outsert contacts may be manufactured to be smooth, as discussed here and in further detail below.

Figure 2:
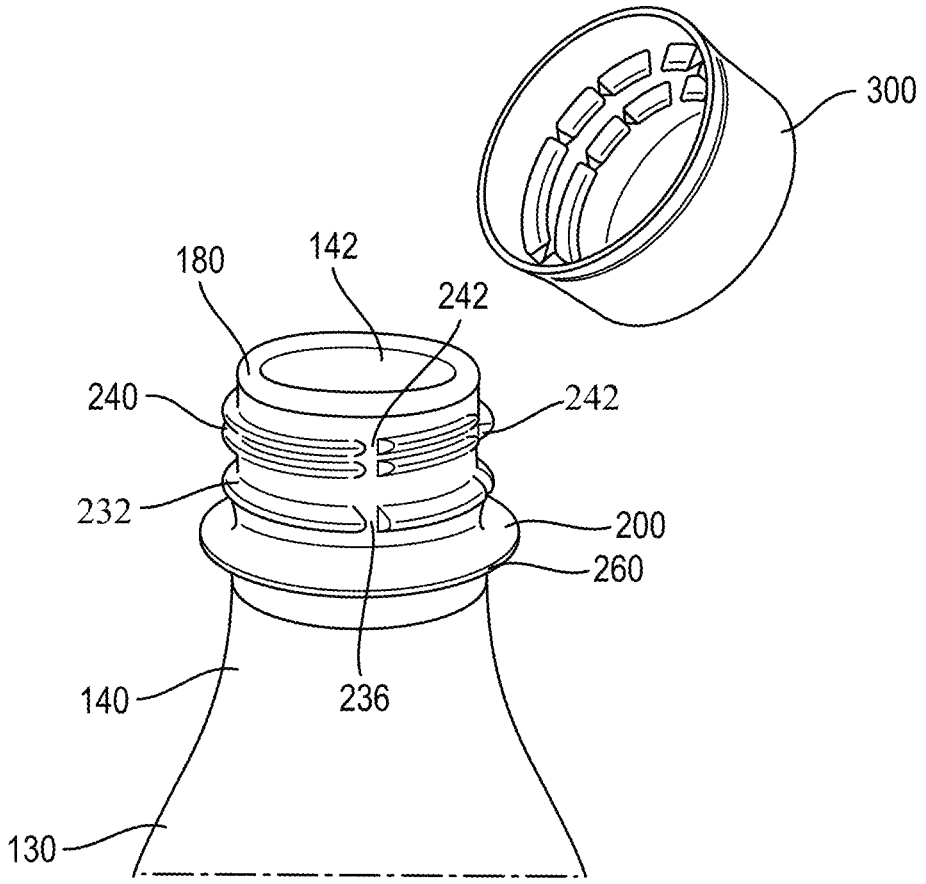
FIG. 2 is a perspective view of a neck finish of the beverage container of FIG. 1.

As shown, for example, in FIGS. 2 and 4, outsert 200 is attached to bottle 100 on neck portion 140. Outsert 200 is cylindrically shaped and encircles part of neck portion 140 extending downwards from near opening 142 when it is attached to bottle 100.

Figure 3:
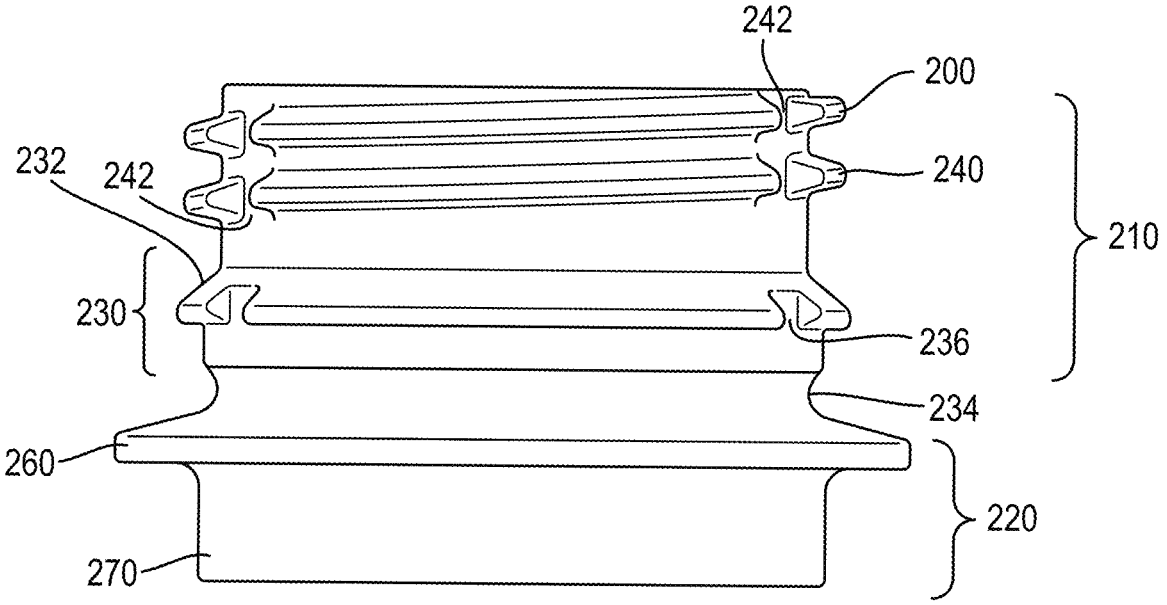
FIG. 3 is a front view of the outsert of the beverage container of FIG. 1.

An embodiment of outsert 200 is shown in FIGS. 3 and 4. An upper portion 210 is disposed above a lower portion 220. In some embodiments, lower portion 220 may have an inner diameter 222 that is larger than an inner diameter 212 of upper portion 210, as shown in FIG. 4. A transition between lower portion 220 and upper portion 210 may taper in a frustoconical shape. In some embodiments, lower portion 220 and upper portion 210 have vertical walls (i.e. are purely cylindrical). In some embodiments, the vertical cross sections of upper portion 210 and lower portion 220 may have a slight inward taper, which may be due in part to incorporation of a draft angle to aid in manufacturability. In some embodiments, some portions of upper portion 210 and lower portion 220 may taper and other portions may be cylindrical. For example, lower portion 220 may be purely cylindrical, while upper portion 210 may have a slight taper.

As shown, for example, in FIG. 4, outsert 200 may have an undercut bottom edge. The undercut bottom edge may aid in assembly of outsert 200 onto neck portion 140, as discussed in further detail below. Threads 240 are disposed on the outer surface of upper portion 210. Threads 240 may be configured as helical threads that are configured to mate with corresponding threads on a bottle cap 300. In some embodiments, threads 240 may also have vertically-oriented gaps 242 in the thread pattern. Gaps 242 may have several purposes. For example, gaps 242 may be configured to allow gas inside of bottle 100 to escape during the unscrewing of bottle cap 300. Gaps 242 may also aid in the elastic deformation of outsert 200, as discussed in further detail below. The specific dimensions of threads 240 (e.g. thread pitch, major diameter, minor diameter, etc.) may be selected to accommodate any desired bottle cap thread configuration. Outsert 200 may be configured to function with a range of diameters of neck portion 140 of bottle 100. For example, some common sizes associated with neck portion 140 may be 26 mm, 28 mm, 33 mm, and 38 mm.

A tamper-evident formation 230 may be disposed on the exterior of upper portion 210 below threads 240. Tamper-evident formation 230 is configured to function with a tamper-evident band 309, which is discussed in further detail below. Together, tamper-evident formation 230 and tamper-evident band 309 function to indicate whether bottle cap 300 has been previously unscrewed. Tamper-evident formation 230 may include any configuration of structures needed to function with tamper-evident band 309. For example, as shown in FIG. 3, tamper-evident formation 230 may include a flange 232 and a groove 234 disposed below flange 232. These structures engage with tamper evident band 309 so that tamper-evident band 309 remains attached to outsert 200 when bottle cap 300 is unscrewed. Flange 232 may also include vertically-oriented gaps 236. Like gaps 242, gaps 236 are configured to enable easier deformation of outsert 200 by providing areas of outsert 200 with thinner wall thickness. In some embodiments, gaps 236 may be vertically aligned with gaps 242 in threads 240. In other embodiments, gaps 236 may be offset from gaps 242. The configuration of tamper-evident formation 230 may be modified to function with different designs of tamper-evident band 309 as needed.

A support flange 260 is disposed on the exterior of lower portion 220. As shown in FIG. 3, an upper surface of support flange 260 may extend radially outward from outsert 200 at an oblique angle with the horizontal, and a lower surface of support flange 260 may extend radially outward from outsert 200 parallel to the horizontal. An engagement portion 270 is disposed below support flange 260. As discussed in further detail below, support flange 260 and engagement portion 270 function together to enable bottle 100 to be gripped by a gripping mechanism 402 of a bottling line 400. Support flange 260 is designed to extend radially outwards from outsert 200 a sufficient distance to allow a gripping mechanism to brace itself against the downward force created by the weight of bottle 100, especially when bottle 100 is filled with a beverage. For example, support flange 260 may extends radially outwards from the exterior surface of lower portion 220 between 2 mm to 5 mm.

Engagement portion 270 extends downwards from support flange 260 a sufficient distance to protect the exterior of bottle 100 from a gripping or conveying mechanism. For example, engagement portion 270 may extend downwards at least as far as the total height of a gripping or conveying mechanism. This ensures that engagement portion 270 is always between the gripping mechanism and the exterior of bottle 100. In some embodiments, engagement portion 270 may extend some distance farther down bottle 100 than the height of the gripping or conveying mechanism to ensure that a minor misalignment between the gripping or conveying mechanism and bottle 100 does not result in the outer surface of bottle 100 being marred or damaged by the gripping or conveying mechanism. For example, engagement portion 270 may extend downwards from support flange 260 by at least 4 mm (e.g., between 4 mm and 6 mm).

Because the preferred installation method of outsert 200, discussed in further detail below, involves pressing outsert 200 onto bottle 100, outsert 200 is able to elastically deform, or stretch beyond its nominal dimensions and then recover back, at least partially, to those resting dimensions. Accordingly, outsert 200 may be made from any desired material with elastic properties. For example, in some embodiments outsert 200 is made from plastic materials, including polypropylene plastic. It is preferable when designing outsert 200 to ensure that the material chosen and design parameters selected (e.g. wall thickness and structural design) are configured to allow elastic deformation over the expected dimensional ranges. For example, in some embodiments, outsert 200 may need to stretch from its initial resting diameter to a diameter that is about 10% larger, +/−2%, during the assembly process, and then may need to recover back to its initial diameter. The design of outsert 200 is preferably tailored to allow full elastic deformation in this diameter range. Further, in some embodiments the inner surface of outsert 200 is smooth, which is to say it does not have any protrusions, grooves, or other surface feature other than a texture naturally imparted by the molding process used to create outsert 200. The smooth contacting surfaces between bottle body 102 and outsert 200 help outsert 200 slide over rolled edge 180 during assembly onto bottle 100.

For example, gaps 242 in threads 240 and gaps 236 in flange 232 may be configured to aid in the elastic deformation of outsert 200. Generally, materials that have varying thicknesses will elastically deform more readily in their thinner sections, because those sections are less able to resist the forces deforming the material. Thus, a material may be designed to elastically deform in specific areas by controlling the thickness of that material, and specifically by making the material thinner where deformation is desired. Here, gaps 242 and gaps 236 may be aligned vertically, with each gap 242 being vertically aligned above one of gaps 236. Gaps 242 and gaps 236 may be a section of neck portion that does not have threads 240 (for gaps 242) or flange 232 (for gaps 236), but otherwise has the same wall thickness as the rest of outsert 200. The absence of these thickening structures (threads 240 and flange 232) effectively reduces the thickness of outsert 200 in gaps 242 and gaps 236. Accordingly, any elastic deformation that outsert 200 experiences will be concentrated in gaps 242 and gaps 236, minimizing deformation and attendant stresses on threads 242 and flange 232. The actual wall thickness of outsert 200 in gaps 242 and gaps 236 may also be modified to adjust the level of deformation that occurs in those sections, with a thinner wall thickness resulting in more deformation, and a thicker wall thickness resulting in less deformation. In some embodiments, gaps 242 and gaps 236 may be spaced equally around the circumference of neck portion 140. For example, there may be between 4 and 8 sets of gaps 242 and gaps 236. The even spacing of gaps 242 and 236 about outsert 200 results in an even deformation of outsert 200 with respect to the circumference of outsert 200. For example, in the case where there are four sets of gaps 242 and gaps 236, each aligned pair of gaps 242 and gaps 236 may be spaced ninety degrees apart from the next pair of gaps 242 and gaps 236.

In some embodiments, outsert 200 may be designed to be heated prior to assembly on bottle 100. In general, heating plastic materials to some extent increases their ability to elastically deform, and thus heating outsert 200 may allow for further flexibility of the material of outsert 200. After assembly, the cooling process of the heated outsert 200 may further aid in recovery of outsert 200 to its pre-stretch dimensions. For example, outsert 200 may be heated to temperature between 80 degrees Fahrenheit and 120 degrees Fahrenheit (e.g., between 90 degrees Fahrenheit and 110 degrees Fahrenheit) prior to assembly. Outsert 200 may be manufactured using any suitable process, such as molding or machining.

As discussed above, and as shown in FIGS. 1, 2, 4, and 6, bottle cap 300 is configured to resealably close bottle 100. Bottle cap 300 engages with outsert 200 after outsert 200 has been installed on bottle 100. As shown, for example, in FIG. 4, embodiments of bottle cap 300 include a circular top portion 302 with cylindrical sidewall 304 disposed along the circumference of top portion 302 and extending downwards from top portion 302. Bottle cap threads 306 are disposed on the inner surface of cylindrical sidewall 304. Bottle cap threads 306 are configured to engage with threads 240 of outsert 200. The discussion above regarding the specific details of threads 240 applies equally to bottle cap threads 306.

Bottle cap 300 is configured to provide a gas-tight seal when it has been screwed onto outsert 200 on bottle 100. Embodiments of bottle cap 300 may be either a "one-piece" or "two-piece" type bottle cap. Two-piece caps include a second piece of deformable material that is attached to the lower surface of upper portion 302. This deformable material deforms around the upper edge of neck portion 140 of bottle 100 as bottle cap 300 is screwed onto bottle 100 and thus provides a gas-tight seal. An embodiment of a one-piece bottle cap 300 is shown in FIGS. 4 and 5. In this embodiment, and other similar embodiments, the seal is provided by a first sealing flange 308 that is an annular flange disposed on the lower surface of upper portion 302. First sealing flange 308 extends downwards from the lower surface of upper portion 302 and is configured to contact the inner wall of neck portion 140 when bottle cap 300 is screwed closed on bottle 100. A second sealing flange 310 is an annular flange disposed radially outwards from first sealing flange 308 on the lower surface of upper portion 302. Second sealing flange 310 also extends downwards from the lower surface of upper portion 302, and as shown, for example, in FIG. 5, is configured to contact the exterior of rolled edge 180 when bottle cap 300 is screwed closed.

The lower surface of upper portion 302 also contacts the top of rolled edge 180 and acts to provide an additional sealing surface. In some embodiments, there may be a seal in the form of an additional protrusion (e.g., a sealing bead) configured to contact the top of rolled edge 180 on the lower surface of upper portion 302. Together, first sealing flange 308, second sealing flange 310, and the lower surface of upper portion 302 are configured to provide a gas-tight seal when bottle cap 300 is screwed closed on bottle 100. In some embodiments, the lower surface of upper portion 302 may not include any additional sealing flanges or structures, beyond first sealing flange 308 and second sealing flange 310, to further seal bottle 100. Specifically, as shown in FIG. 5, there is no sealing flange, groove, land, or other protrusion on the lower surface of upper portion 302 in the annular area between first sealing flange 308 and second sealing flange 310 where upper portion 302 contacts rolled edge 180.

In some embodiments a tamper evident band 309 is part of bottle cap 300. For example, as shown in in FIG. 4, tamper evident band 309 may be removably attached to the lower edge of sidewall 304. Tamper evident band 309 is configured to interact with tamper evident formation 230 of outsert 200. When bottle cap 300 is unscrewed from bottle 100 for the first time, tamper evident band 309 detaches from bottle cap 300 and remains on bottle 100. This indicates that bottle 100 has been opened to a consumer, which is desirable for safety reasons.

As shown in FIG. 4, in some embodiments tamper evident band 309 may be configured to be captured by flange 232. Because the connection between bottle cap 300 and tamper evident band 309 is configured to be detachable, when bottle cap 300 is unscrewed tamper evident band 309 detaches from bottle cap 300 and remains captured by flange 232. Other configurations of tamper evident band 309 may be used to achieve the same result as the configuration described here.

Bottle cap 300 may be made from any suitable material. In particular bottle cap 300 may be made from a plastic such as a polypropylene or polyethylene plastic. Bottle cap 300 may be manufactured using any known technique that is suitable for bottle cap manufacture, such as molding. Bottle cap 300 may be designed to have similar properties and dimensions as those of a bottle cap that is used on plastic bottling line. This further enhances compatibility with bottling line 400.

Figure 7A:
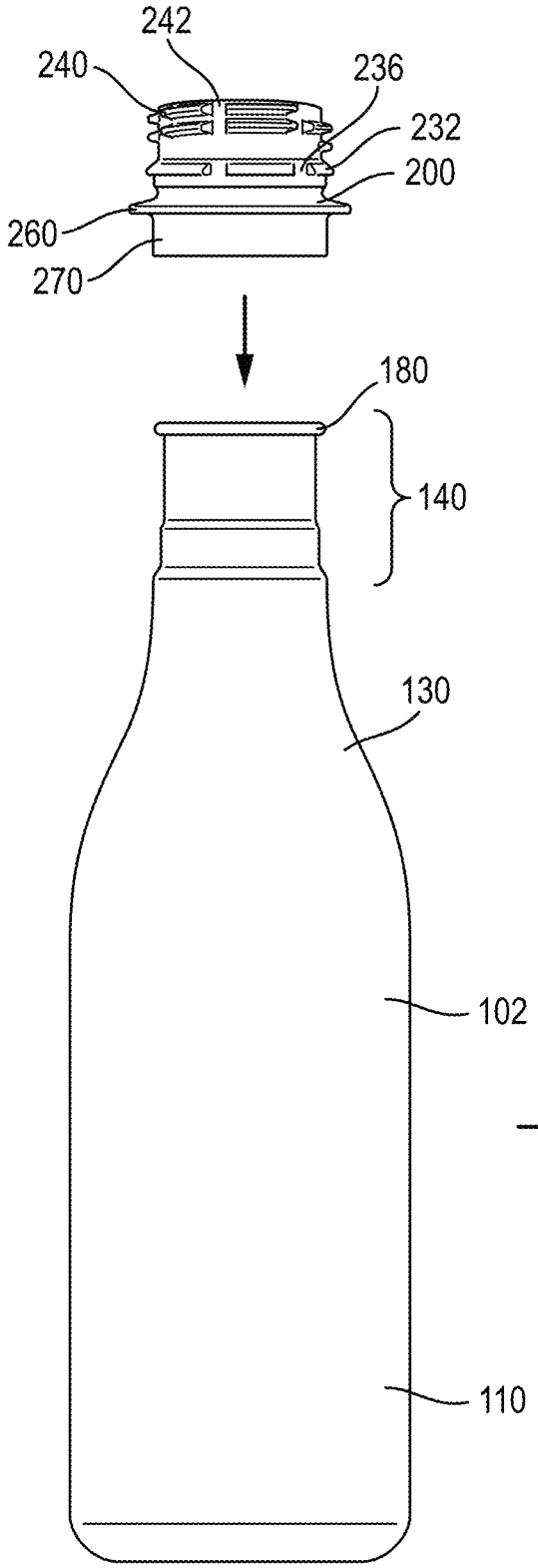
FIG. 7A is a diagram of an assembly process of the beverage container of FIG. 1.
Figure 7B:
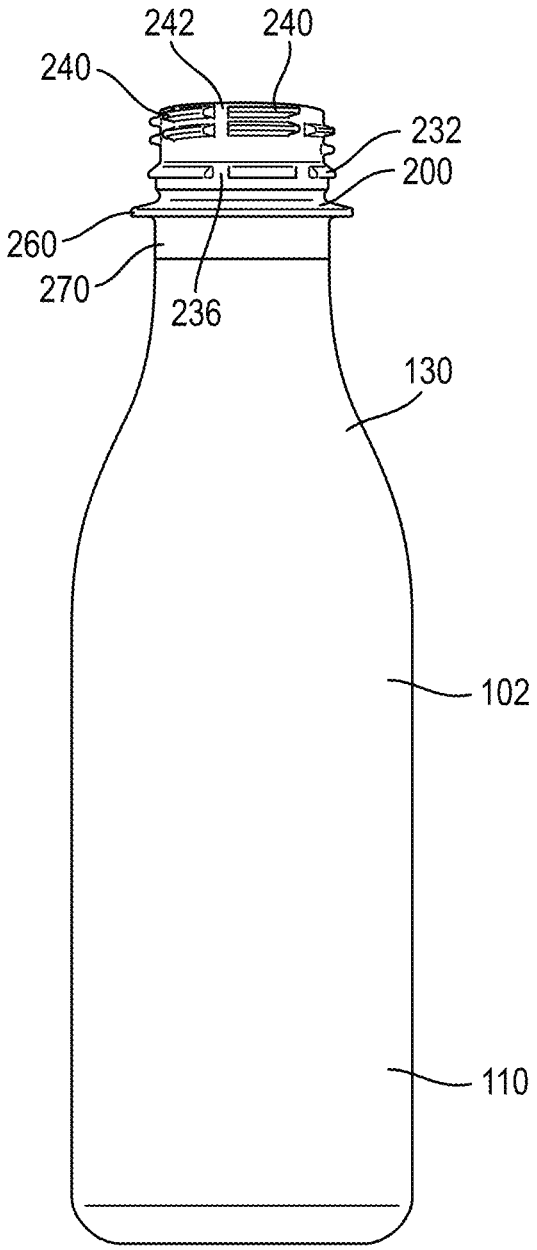
FIG. 7B is a diagram of an assembly process of the beverage container of FIG. 1.

A method of manufacturing bottle 100 with outsert 200 according to some embodiments begins with bottle 100 manufactured as discussed above. Outsert 200 is manufactured separately from bottle 100. As shown in FIG. 7A, outsert 200 is then pressed on neck portion 140 of bottle 100. FIG. 7B shows outsert 200 after pressing on neck portion 140 of bottle 100. The design of outsert 200 enables outsert 200 to elastically deform as it passes over rolled edge 180 and then recover such that the inner surface of outsert 200 forms an interference fit with the outer surface of neck portion 140. For example, referencing FIG. 4, the smaller of inner diameter 212 of upper portion 210 and inner diameter 222 of lower portion 220 may be between 20 mm and 36 mm. The magnitude of the smallest inner diameter of outsert 200 may be influenced by the size of neck portion 140 of bottle 100 onto which outsert 200 is intended to be put. For example, an outsert 200 intended for use with a 26 mm neck finish may have a minimum inner diameter of 22 mm to 24.3 mm, and may stretch to 26 mm to fit over the a 26 mm outer diameter of rolled edge 180 (which outer diameter for a 26 mm neck finish may be 23-26 mm). This and other examples are shown in the table below.

| Neck Finish Nominal Size | Minimum Inner Diameter | Stretched Inner Diameter | Outer Diameter of Rolled Edge |
|---|---|---|---|
| 26 mm | 22 mm to 24.3 mm | 23 mm to 26 mm | 23 mm to 26 mm |
| 28 mm | 22 mm to 24.3 mm | 23 mm to 26 mm | 23 mm to 26 mm |
| 33 mm | 25 mm to 29.5 mm | 28 mm to 31 mm | 28 mm to 31 mm |
| 38 mm | 30.5 mm to 34.7 mm | 33 mm to 36 mm | 33 mm to 36 mm |

For example, the smaller of inner diameter 212 of upper portion 210 and inner diameter 222 of lower portion 220 may be 22.8 mm, while exterior diameter 182 of rolled edge 180 may be 24.3 mm, and therefore when applied to bottle 100, outsert 200 will stretch its minimum inner diameter of 22.8 mm to 24.3 mm to pass over rolled edge 180, and then to recover back to design dimensions (i.e., recover back to its original inner diameter, except for any interference due to its fit around neck portion 140). In these examples, at least a part of neck portion 140 will have an external diameter that is greater than or equal to an inner diameter of a corresponding part of outsert 200, and thus an interference fit can be formed by outsert 200 when it is pressed on bottle 100. In these embodiments, the diameter of rolled edge 180 is larger than that of at least a part of neck portion 140, and rolled edge 180 can serve to restrain upward movement of outsert 200. In some embodiments, outsert 200 is pressed onto bottle 100 such that the upper edge of outsert 200 is disposed immediately below rolled edge 180.

As discussed above, both the interior of outsert 200 and the exterior of neck portion 140 that outsert 200 covers after assembly may be smooth, without any structures, grooves, protrusions, or the like. The smooth interior of outsert 200 enables outsert 200 to slide over rolled edge 180 more easily and without damage. Further, in some embodiments, there are no adhesives or other fixing mechanisms used to secure outsert 200 to bottle 100. Accordingly, in some embodiments only the interference fit between outsert 200 and neck portion 140 fixes outsert 200 to bottle 100. In particular, the interference fit between outsert 200 and neck portion 140 is sufficient, on its own, to provide enough friction between outsert 200 and neck portion 140 to prevent outsert 200 from twisting during the capping and uncapping of bottle cap 300.

Thus adhesives or cooperating surface structures (e.g., grooves, protrusions, or other fixing structures on either the inner surface of outsert 200 or the outer surface of neck portion 140 that is covered by outsert 200) are not needed. Using only an interference fit also promotes ready separation of outsert 200 from bottle 100 during a recycling process where bottle 100 is shredded.

In some embodiments, outsert 200 may be heated prior to pressing onto bottle 100. This further enables outsert 200 to elastically deform over rolled edge 180 and then to recover back to a smaller diameter because plastic materials elastically deform more easily at higher temperatures.

Figure 9:
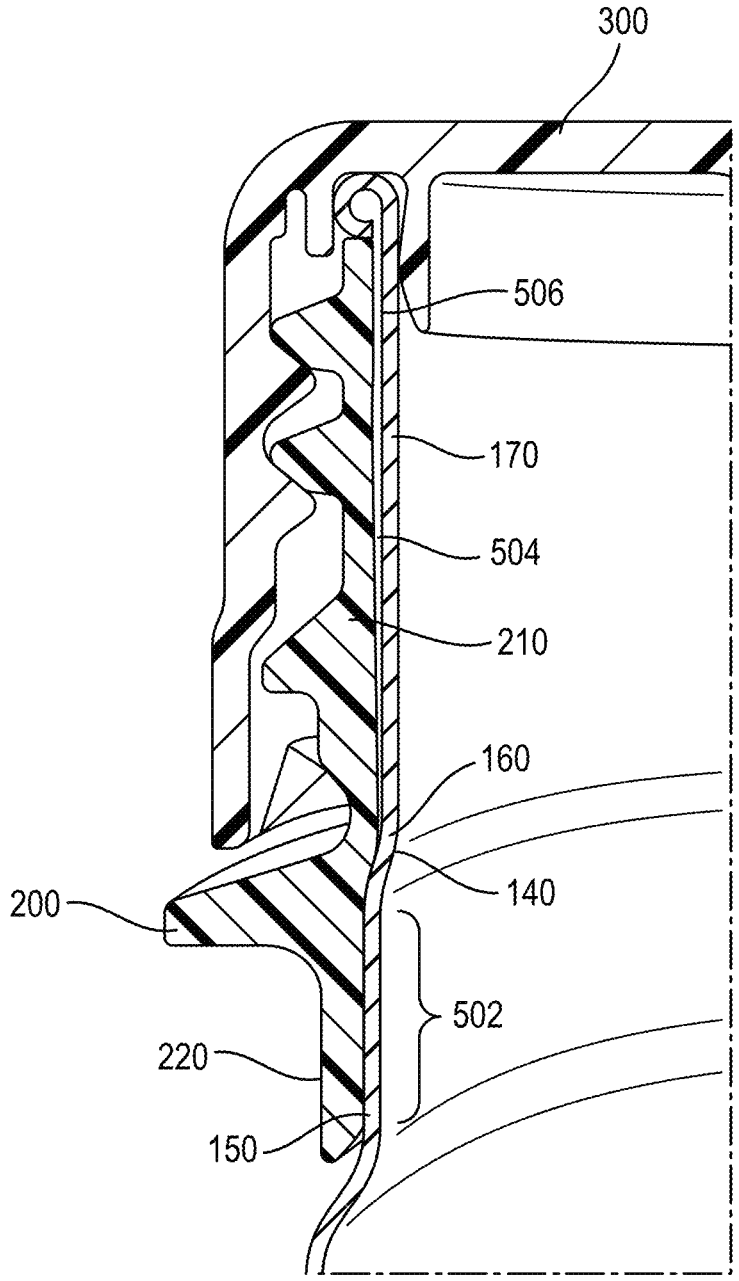
FIG. 9 is a detail cross-sectional view of a portion of the neck finish of the beverage container of FIG. 1.

As shown in FIG. 9, in some embodiments outsert 200 is configured to have an interference fit with neck portion 140 in an interference region 502 that includes at least part of lower portion 220. In some embodiments, as shown in FIG. 9, interference region 502 may comprise most or all of lower portion 220. In these embodiments, there is a gap 504 between outsert 200 and neck portion 140 extending upwards from interference region 502. In some embodiments, gap 504 may extend the entire length of outsert 200 upwards from interference region 502, as shown, for example, in FIG. 9. In other embodiments, gap 504 may extend to just below the top edge of upper portion 210, where outsert 200 again contacts neck portion 140 in a contact region 506. For example, gap 504 may extend between 30% to 70% of the total height of outsert 200. In some embodiments, contact region 506 may also have an interference fit with neck portion 140. The presence of gap 504 allows outsert 200 to have a greater inner diameter in some sections (e.g., in upper portion 210), which allows outsert 200 to be assembled onto bottle 100 more easily, and in particular allows outsert 200 to slip more easily over rolled edge 180. In some embodiments, the top edge of outsert 200 may contact the lower part of rolled edge 180, to help locate and maintain a stable position of outsert 200, as shown, for example, in FIG. 9.

This method of assembling outsert 200 onto bottle 100 has several advantages. First, it can be used with a bottle 100 that has been pre-formed. This can streamline and reduce the costs of manufacturing and sourcing bottle 100, and also can enable the use of bottles that are pre-formed because this assembly method does not require application of outsert 200 onto bottle 100 at a certain stage of manufacture (e.g. before rolled edge 180 is formed). This also enables use of faster forming methods for bottle 100 that may not necessarily be easily adaptable to insertion of an outsert during assembly. For example, the sheet-forming method of assembly of bottle 100 described above happens very quickly, and trying to introduce a new step for application of an outsert could make the bottle-formation process both slower and more costly. This contrasts with bottles made using a slug-forming method, which is slower than sheet forming, and is thus more adaptable to introducing a new step for application of an outsert onto a partially-formed bottle during the bottle-forming process. Although outsert 200 can, of course, be used with the slug-forming method of bottle forming, it is particularly suited for use with techniques such as sheet forming that are more suited for producing fully-formed bottles without interruption because outsert 200 is designed for assembly onto a fully-formed bottle due to its ability to elastically deform over a finished rolled edge 180. Further, because outsert 200 is not fixed to bottle 100 using adhesives, recycling bottle 100 and outsert 200 after assembly is easier because outsert 200 can separate from bottle body 102 more cleanly (e.g., when bottle 100 is shredded in a recycling operation). In some embodiments, outsert 200 may comprise a magnetic material mixed into its material, such as steel or iron, to enable magnetic sorting of outsert 200 from non-magnetic embodiments of bottle 100 during recycling. For example, small amounts of steel may be incorporated into plastic versions of outsert 200 to enable a magnet to attract outsert 200 during recycling.

Figure 8:
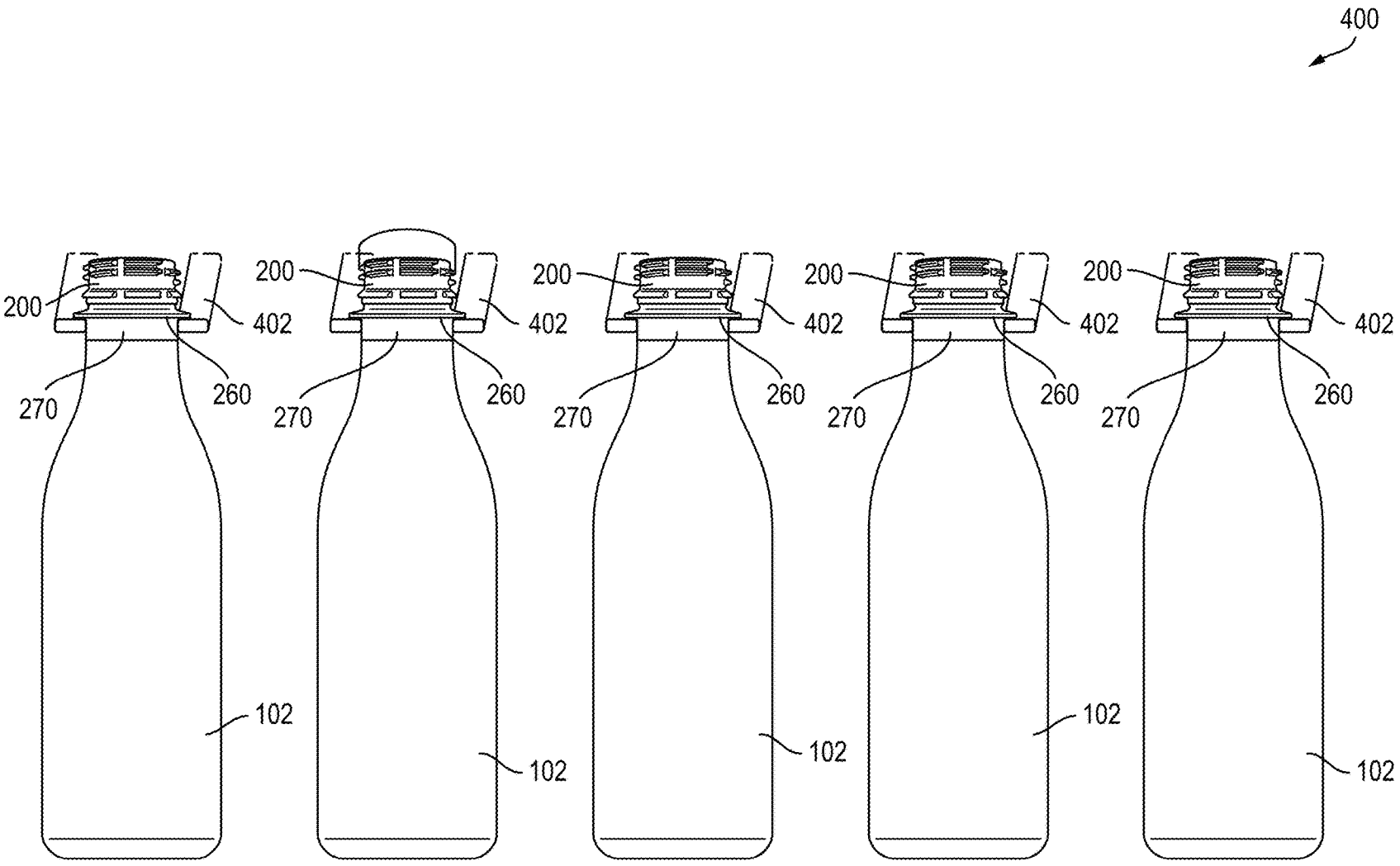
FIG. 8 is a side view of the beverage container of FIG. 1 in a plastic bottling line.

As shown in FIG. 8, a method of using bottle 100 with outsert 200 on bottling line 400 involves placing bottle 100 into gripping mechanism 402. As discussed above, the design of outsert 200 enables bottle 100 to be gripped by gripping mechanism 402, even when gripping mechanism 402 is on bottling line 400 that is configured to fill plastic bottles only. Outsert 200, and in particular flange 260 and engagement portion 270 act to protect the exterior of bottle 100 as it passes through bottling line 400. Because dimensions of bottle 100 with outsert 200 attached are similar to those of a plastic bottle, bottle 100 may be used on bottling line 400 with little or no modification to bottling line 400. This reduces cost and complexity of bottling bottle 100. Further, because plastic bottling lines like bottling line 400 are some of the most common types of bottling lines, this enables metal beverage containers to be bottled in a wider range of pre-existing facilities. FIG. 8 shows an example gripping mechanism 402 that is representative of a "knife and plate" type. It should be understood that the design of outsert 200 may also function with any type of gripping mechanism 402, and also with any "airveyor" type systems. An "airveyor" system uses a continuous guide rail that has a gap between a pair of continuous rails, where the gap is sized to allow neck portion 140 to slide. The continuous rails rest against outsert 200 to transport bottle 100 into or through bottling line 400. Bottle 100 is moved along the airveyor by currents of air directed at bottle 100.

After loading onto bottling line 400, bottle 100 is filled with a beverage on bottling line 400, and then capped with bottle cap 300. Here, again, the cost and complexity of filling bottle 100 are reduced because bottle cap 300 is designed to be similar to a bottle cap used on a plastic bottle, and this allows bottle 100 to be capped on bottling line 400 with minimal modification to bottling line 400.

It is to be appreciated that the Detailed Description section, and not the Summary and Abstract sections, is intended to be used to interpret the claims. The Summary and Abstract sections may set forth one or more but not all exemplary embodiments of the present invention as contemplated by the inventor(s), and thus, are not intended to limit the present invention and the appended claims in any way.

The foregoing description of the specific embodiments will so fully reveal the general nature of the invention that others can, by applying knowledge within the skill of the art, readily modify and/or adapt for various applications such specific embodiments, without undue experimentation, without departing from the general concept of the present invention. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present invention should not be limited by any of the above-described exemplary embodiments, but should be defined only in accordance with the claims and their equivalents.

What is claimed is:

1. An outsert for a bottle, the outsert comprising:

an upper portion, wherein the upper portion has a smooth, continuous interior surface;

threads disposed on an exterior surface of the upper portion;

a lower portion disposed below the upper portion, wherein the lower portion has a smooth, continuous interior surface; and a support flange disposed on an exterior surface of the lower portion, wherein a transition between the upper portion and the lower portion tapers inward toward the upper portion, wherein an inner diameter of the upper portion is less than an inner diameter of the lower portion, and wherein at least one of the upper portion and the lower portion is configured to temporarily elastically deform to a diameter larger than its resting diameter and then to recover back to its resting diameter.

2. The outsert of claim 1, wherein an upper surface of the support flange extends away from the exterior surface of the lower portion at an angle with the horizontal, and wherein a lower surface of the support flange extends away from the exterior surface parallel to the horizontal.

3. The outsert of claim 1, further comprising:

a tamper-evident formation disposed on the upper portion that is configured to enable use of a tamper evident band on a bottle cap.

4. The outsert of claim 3, wherein the tamper-evident formation has gaps therethrough.

5. The outsert of claim 4, wherein the tamper evident formation comprises a flange disposed on the outer surface of the upper portion, and wherein the gaps are disposed on the flange.

6. The outsert of claim 1, wherein an engagement portion of the lower portion extends below the support flange, and wherein at least one of the support flange and engagement portion are configured to engage with a gripping mechanism of a bottling line.

7. The outsert of claim 1, wherein the outsert comprises polypropylene material.

8. The outsert of claim 1, wherein the smaller of the inner diameter of the upper portion and the inner diameter of the lower portion is 22 mm to 24.3 mm, and wherein the outsert is configured to enable the smaller of the inner diameter of the upper portion and the inner diameter of the lower portion to temporarily stretch to 23 mm to 26 mm and then recover to the smaller of the interior diameter of the upper portion and the interior diameter of the lower portion.

9. A bottle comprising the outsert of claim 1, wherein at least one of the inner diameter of the upper portion and the inner diameter of the lower portion creates an interference fit with a neck portion of the bottle.

10. The outsert of claim 1, wherein a bottom edge of the outsert comprises an undercut taper.

11. A bottle, comprising:

a metal body, the metal body comprising a neck portion, wherein the neck portion comprises:

a rolled upper edge;

an upper region disposed below the rolled upper edge, the upper region having a first outer diameter;

a lower region disposed below the upper region, the lower region having a second outer diameter, greater than the first outer diameter; and a tapered transition region disposed between the upper region and the lower region; and the outsert of claim 1 disposed on the neck portion, wherein the upper portion of the outsert is disposed around the upper region of the body, and wherein the upper portion of the outsert does not contact at least a part of the upper region of the body; and wherein the lower portion of the outsert is disposed around the lower region of the body, and wherein the lower portion of the outsert contacts at least a portion of the lower portion of the body.

12. The bottle of claim 11, wherein both the inner diameter of the upper portion and the inner diameter of the lower portion are less than an outer diameter of the rolled edge, and wherein an upper edge of the upper portion is disposed immediately below the rolled edge.

13. The bottle of claim 11, further comprising:

a bottle cap removably disposed on the outsert, the bottle cap comprising:

a circular top portion;

a cylindrical sidewall extending downwards from an outer perimeter of the top portion;

second threads disposed on an inner surface of the cylindrical sidewall, wherein the second threads are configured to mate with the threads of the outsert;

an inner sealing flange extending downwards from a bottom surface of the top portion, wherein the inner flange is configured to contact an inner wall of the neck portion when the bottle cap is secured on the outsert; and an outer sealing flange disposed on the bottom surface of the top portion radially outward from the inner sealing flange, wherein the outer sealing flange is configured to contact an exterior surface of the rolled edge when the bottle cap is secured on the outsert, wherein the bottle cap does not include a sealing flange configured to contact an upper surface of the rolled edge.

14. The bottle cap of claim 13, further comprising a tamper evident band disposed below the cylindrical sidewall, wherein the tamper evident band is configured to engage a tamper evident formation disposed on the upper portion of the outsert, and wherein the tamper evident band is configured to detach from the cylindrical sidewall when the bottle cap is removed from the outsert.

15. The bottle of claim 11, wherein the metal body is formed from rolled sheet metal.

16. The bottle of claim 11, the metal body further comprising a tapered portion disposed below the neck portion, wherein the outsert extends from the rolled edge to the tapered portion.

17. The bottle of claim 11, wherein at least the lower portion is configured to contact the body with an interference fit.

18. The bottle of claim 11, wherein the outsert is formed from polypropylene.

19. The bottle of claim 11, wherein exterior surfaces of the body that contacts the outsert are smooth.

20. A method of manufacturing a metal beverage container comprising a neck portion having an upper region disposed above a lower region, the method comprising:

pressing the outsert of claim 1 over a rolled edge disposed at an upper edge of the neck portion such that an upper edge of the outsert is disposed immediately below the rolled edge, wherein the rolled edge has an external diameter greater than the internal diameter of the upper edge of the outsert, wherein during pressing an inner diameter of the outsert expands to fit over the external diameter of the rolled edge and then the expanded inner diameter of the outsert recovers such that a portion of the outsert is in contact with at least one of the upper region and the lower region, and wherein the recovered inner diameter of the outsert is less than the outer diameter of at least one of the upper region and the lower region such that the outsert is secured to the neck portion with an interference fit.

21. The method of claim 20, wherein after pressing, the outsert contacts a portion of both the upper region and the lower region, and wherein the outsert does not contact a portion of the upper region.

22. The method of claim 20, wherein exterior surfaces of the upper region and the lower region are smooth.

23. The method of claim 20, wherein the outsert comprises an engagement portion disposed below the support flange.

24. A method of using a metal beverage container on a plastic bottle line, the method comprising:

manufacturing a metal beverage container adapted for use on the plastic bottling line per the method of claim 23;

loading the metal beverage container onto the plastic bottling line, wherein during loading a gripping mechanism of the bottling line grips the engagement portion of the outsert below the support flange such that the exterior surface of the metal beverage container does not contact the gripping mechanism, wherein the support flange contacts an upper surface of the gripping mechanism;

filling the metal beverage container with a beverage; and applying a bottle cap to the outsert such that the metal beverage container is closed in a fluid-tight manner.

25. The method of claim 20, further comprising:

heating the outsert before pressing the outsert onto the metal beverage container, wherein the outsert comprises a plastic material.

26. The outsert of claim 1, wherein at least one of the upper portion and the lower portion is configured to temporarily elastically deform to a diameter 10% larger than its resting diameter and then to recover back to its resting diameter.

* * * * *